US006056376A

United States Patent [19]

Yenglin et al.

[11] Patent Number: 6,056,376

[45] Date of Patent: May 2, 2000

[54] DISPLAY CASE

[75] Inventors: Daniel Yenglin, Charlevoix, Mich.; Neil Berg, Albert Lea, Minn.

[73] Assignee: Streater, Inc., Albert Lea, Minn.

[21] Appl. No.: 09/176,382

[22] Filed: Oct. 21, 1998

[51] Int. Cl.[7] ..... E05D 15/26

[52] U.S. Cl. ..... 312/139.1; 312/138.1; 312/322

[58] Field of Search ..... 312/138.1, 139.1, 312/324, 326, 140, 322, 329, 216; 292/159, DIG. 18; 70/78, 85, 86; 49/254, 257, 259; 160/203, 210, 199, 214, 206, 185, 198, 204, 213, 201

[56] References Cited

U.S. PATENT DOCUMENTS

| | | | |
|---|---|---|---|
| 184,375 | 11/1876 | Hansen | 312/329 X |
| 746,758 | 12/1903 | Stiggleman | 312/329 X |
| 2,001,106 | 5/1935 | Mullen . | |
| 2,087,904 | 7/1937 | Flood . | |
| 2,665,370 | 1/1954 | Kurtzon | 312/140 X |
| 3,337,281 | 8/1967 | Walhout | 312/324 X |
| 3,339,995 | 9/1967 | Bencene | 312/322 |
| 3,353,888 | 11/1967 | Pritelli, Jr. . | |
| 3,376,668 | 4/1968 | Smedstad . | |
| 4,348,069 | 9/1982 | Lindsay . | |
| 4,660,902 | 4/1987 | Resendez, Jr. . | |
| 4,702,534 | 10/1987 | Witt et al. . | |
| 4,945,972 | 8/1990 | Takeuchi | 312/322 X |
| 5,108,165 | 4/1992 | Rorke et al. | 312/322 |
| 5,131,449 | 7/1992 | Winn et al. | 312/322 X |
| 5,558,416 | 9/1996 | Dumitru . | |
| 5,690,402 | 11/1997 | Koppe . | |

FOREIGN PATENT DOCUMENTS

| | | | |
|---|---|---|---|
| 395733 | 7/1933 | United Kingdom | 292/159 |

*Primary Examiner*—Janet M. Wilkens
*Attorney, Agent, or Firm*—Jacobson & Johnson

[57] ABSTRACT

A security cabinet having a pair of bifold doors that can be extended into end to end engagement with each other and held there by a closure strip to cover an opening in a cabinet with a locking mechanism for securing the bifold doors therein to prevent access to the interior of the cabinet when in a closed position and slideable hinges for pivotally and slideably supporting the bifold doors to permit the bifold doors to be folded and slid into an out of the way condition along the side walls of the cabinet to allow a person to obtain access to articles in the interior of the cabinet when in an open position.

9 Claims, 5 Drawing Sheets

DISPLAY CASE

FIELD OF THE INVENTION

This invention relates generally to product cabinets and, more specifically, to a product security cabinet for displaying and holding products, such as tobacco products or other small and expensive items, with the product security cabinet including doors that can be locked to prevent unauthorized access to the products therein, with the doors hingeably and slideably mounted to be tucked out-of-the-way so as not to interfere with display and access to products located therein.

BACKGROUND OF THE INVENTION

One of the problems encountered by merchants is the difficulty of controlling access to product display cases and more particularly to display cases that contain tobacco products or other small but valuable items. During store hours, the merchant needs to have free access to the products in the display case so that products can be sold to a customer; however, after store hours the merchant needs to lock the cabinet to prevent unauthorized access to the products located therein. This particularly true if the products is a tobacco product. The present invention provides a security cabinet that includes doors that can be locked to prevent unauthorized access thereto and that can be opened and tucked out of the way so that the product case forms an attractive display case.

DESCRIPTION OF THE PRIOR ART

U.S. Pat. No. 2,087,904 shows a display cabinet that can be disassembled.

U.S. Pat. No. 2,001,106 discloses a show case with an angled front panel that can be pivoted backward to provide access to the contents of the show case.

U.S. Pat. No. 3,376,668 discloses a roll-up closure for vehicles that includes doors that slide along tracks.

U.S. Pat. No. 3,353,888 discloses a furniture article having frames for supporting glass panels therein.

U.S. Pat. No. 5,690,402 shows a product display case having detachable and separable upper and lower units.

U.S. Pat. No. 4,702,534 discloses a winged display case with items displayed in the center case and pictures and related items mounted in the wings of the display case.

U.S. Pat. No. 4,660,902 discloses a locking device for securing hinged doors to a cabinet.

U.S. Pat. No. 4,348,069 discloses a cabinet corner door that folds to permit access to a comer region of the cabinet.

U.S. Pat. No. 5,558,416 discloses a cabinet for displaying objects with a plurality of sides containing transparent material.

SUMMARY OF THE INVENTION

Briefly, the invention comprises a security cabinet having a pair of bifold doors that can be extended into an end-to-end engagement with each other through a closure strip to cover an opening in the cabinet, a locking mechanism for securing the bifold doors therein to prevent access to the interior of the cabinet, and a pair of slideable hinges for pivotally and slideably supporting the bifold doors to permit the bifold doors to be folded and slid into an out-of-the-way condition along the side walls of the cabinet to allow a person to obtain access to articles in the interior of the cabinet as well as to display the contents of the cabinet.

DESCRIPTION OF THE PREFERRED EMBODIMENT

Figure 1:
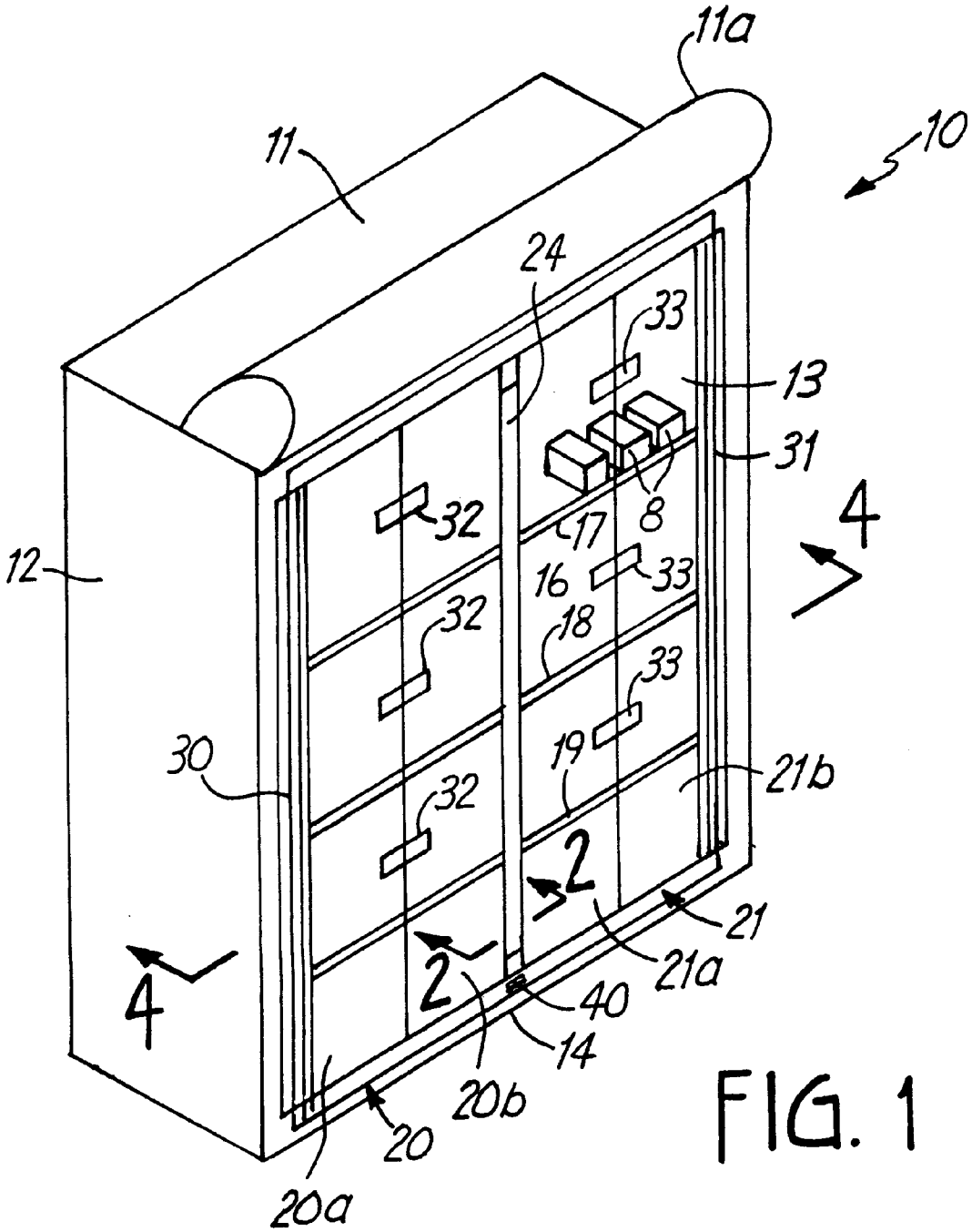
FIG. 1 is a perspective view of the security cabinet of the present invention.
Figure 4:
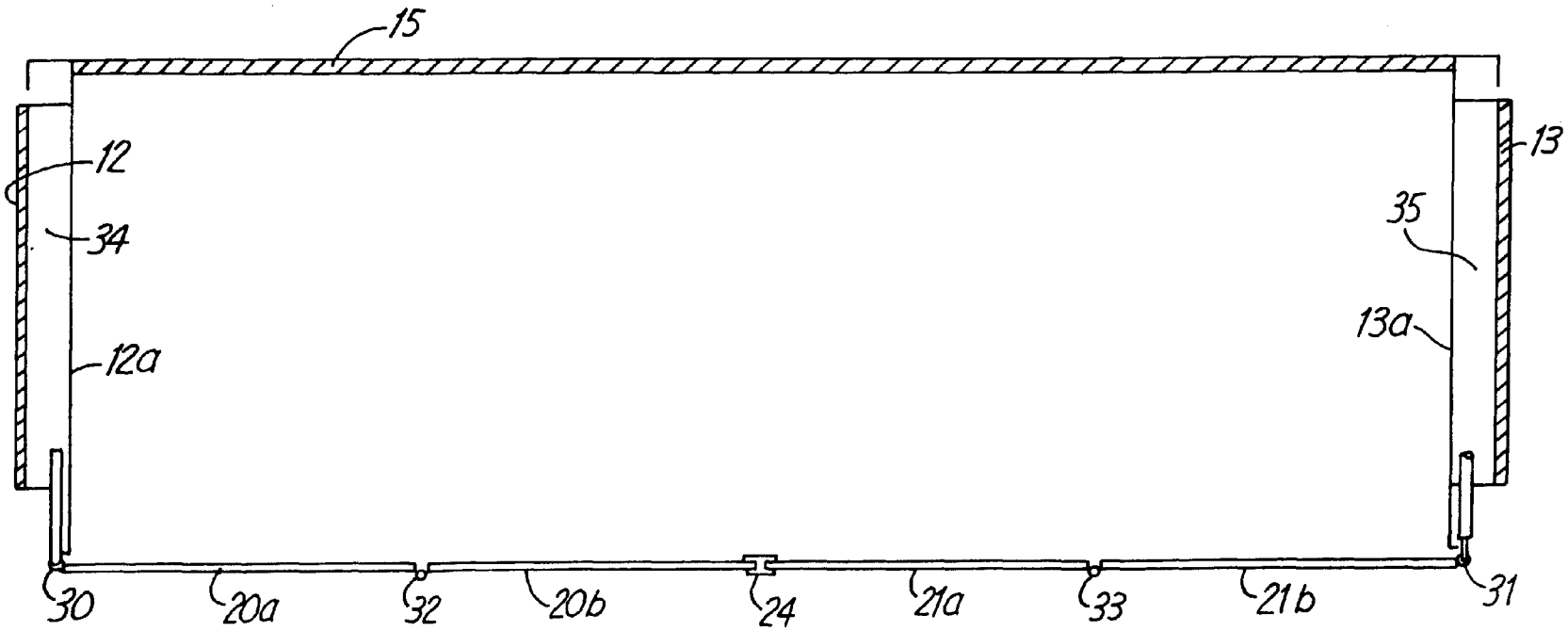
FIG. 4 is a sectional view taken along lines 4—4 of FIG. 1 to show the bifold doors and cabinet in a closed condition.

Referring to drawings, FIG. 1 shows a perspective view of a security cabinet 10 for displaying products in a locked or unlocked condition while allowing locking of the cabinet 10 at night time and providing access to the cabinet during store hours. FIG. 4 shows a cross-sectional view of cabinet 10 with the doors in a closed condition. Cabinet 10 is made of metal and includes a cabinet housing comprising a pair of opposing side walls 12 and 13, a bottom section 14, a top section 11 and a back wall 15 (see FIG. 4) that are connected together to form a rectilinear shaped front opening and an interior space 16 having adjustable shelves 17, 18, and 19 for holding packages of products 8 thereon.

The security cabinet 10 includes a light 11*a*extending along the top section 11 to provide illumination of the interior space of security cabinet 10. Cabinet 10 includes a first glass bifold door 20 having a first rigid glass panel 20*a* and a second rigid glass panel 20*b* which are hingeably secured to each other by hinges 32. Glass bifold door 20 has a hinge 30 located along one edge to permit first rigid glass panel 20*a* and second rigid glass panel 20*b* to be unfoldably extended to a closed condition (where the first rigid glass panel 20*a* and the second rigid glass panel 20*b* are located in an end to end relationship and in substantial planer alignment with each other as illustrated in FIG. 1. Similarly, cabinet 10 includes a second glass bifold door 21 having a third rigid glass panel 21*a* and a fourth rigid glass panel 21*b* which are hingeable secured to each other by hinges 33. Glass bifold door has a hinge 31 located thereon to permit third rigid glass panel 20*b* and fourth rigid glass panel 21*b* to be foldably extended to a closed condition where the third rigid glass panel 21*a* and the fourth rigid glass panel 21*b* are located in an end to end relationship and in substantial planer alignment with each other as illustrated in FIG. 1.

Figure 2:
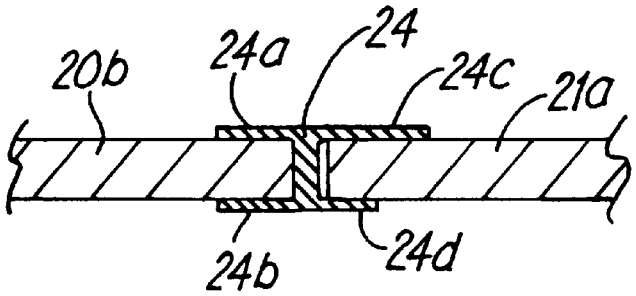
FIG. 2 is a sectional view taken along lines 2—2 of FIG. 1 to show the end to end relationship of the panels when the bifold doors of the cabinet are in a closed condition.

Located between panels 20*b* and 21*a* is a rigid elongated closure strip 24 having jaws on each side. FIG. 2 shows elongated closure strip 24 having jaws 24*a* and 24*b* frictionally engaging an edge portion of second panel 20*b* so as not to be normally removable therefrom. The opposite side of closure strip 24 includes a pair of jaws 24*c* and 24*d* having an opening sufficiently large therebetween so as to permit an edge portion of third panel 21*a* to be engageable and disengaged therein. In the engaged condition, shown in FIG. 2, third panel 21*a* and second panel 20*b* are held in an edge to edge relationship and in substantial alignment with each other so that the panels coact with cabinet housing 10 and locking mechanism 50 to form a front closure to prevent unauthorized access therein. When panels 20*a*, 20*b*, 21*a* and 21*b* are made of glass, it is apparent that the products can be displayed and viewed through the panels. Thus, the merchant has the option of maintaining the cabinet in a closed condition while still displaying the products therein to customers.

Figure 3:
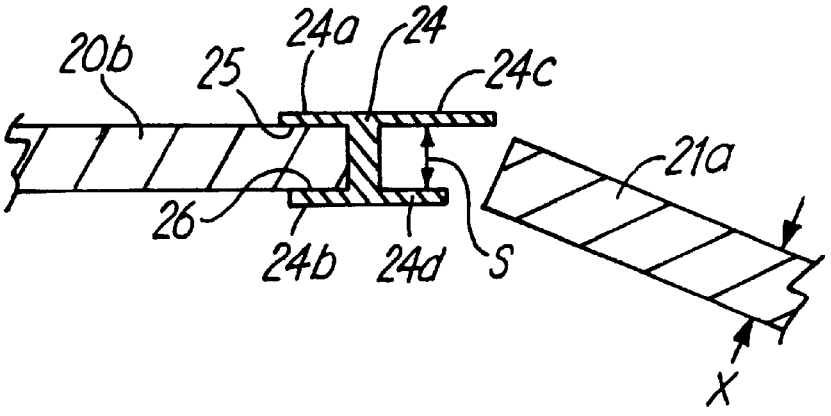
FIG. 3 is a sectional view similar to FIG. 2 showing how the panels on adjacent bifold doors can be disengaged from each other to permit the bifold doors to be folded.

FIG. 3 shows that when the bifold doors 20 and 21 are opened, the closure strip 24 remains with second panel 20*b* as griping member 25 formed by ridges on jaw 24*a* and gripping member 26 formed by ridges on jaw 24*b* coact to hold closure strip 24 thereon while the third panel 21*a* is allowed to be moved free of jaws 24*c* and 24*d*. That is, the width of panel 21*a*, which is denoted by "x", is less than the width "s" between jaws 24*c* and 24*d*. In the embodiment shown, jaw 24*c* is longer than jaw 24*d* to enable the longer jaw 24*c* to act as a guide to direct the edge portion of third panel 21*a* therein.

FIG. 4 illustrates a first hinge 30 slideably mounted on wall 12*a* to slide in and out of pocket 34, and a second hinge 31 slideably mounted on wall 13*a* with the bifold door 21 located in pocket 35 of wall 13, and the bifold door 20 located in pocket 34 of wall 12.

Figure 5:
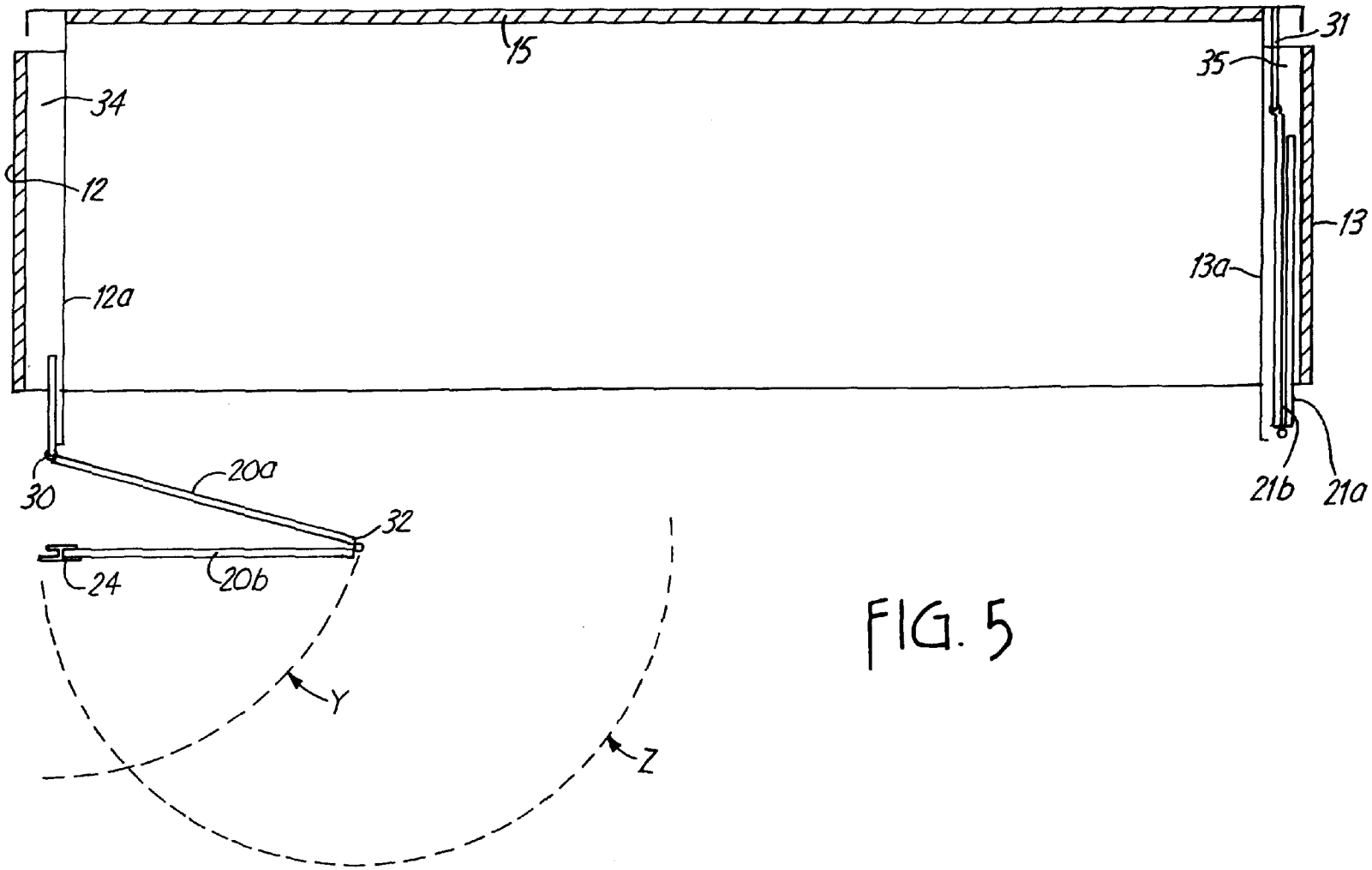
FIG. 5 is a sectional view similar to FIG. 4 showing how the bifold doors can be folded and how the bifold doors can be slid out of the way to permit frontal access to the cabinet.

FIG. 5 illustrates a first hinge 30 slideable mounted on wall 12*a* and in a condition to slide into pocket 34, and a second hinge 31 slideably mounted on wall 13*a* with the bifold door 21 and slideable hinge 31 located in pocket 35 of wall 13. The hinge 30 pivotally supports first panel 20*a*, as first panel 20*a* and second panel 20*b* are folded toward each other as indicated by the set of dotted lines "z". Similarly, the hinge 31 pivotally supports fourth panel 21*b* and third panel 21*a* when the folded panels are located in pocket 35.

As can be seen from FIG. 5, the right side illustrates slideable hinge mechanism 31 in the stored or out-of-the-way condition to thereby provide free access to the front of cabinet 10. With the cabinet 10 in the open condition, both bifold doors 20 and 21 and their respective panels would be slid backward into their respective pockets 34 and 35 so as to be in an out-of-the-way condition to enable a person to obtain access to the interior space of said cabinet housing. The panels 20*b* and 21*a* are separated from a closed position by the application of a slight outward pressure on door 21. Second panel 20*b* folds back along dotted lines "z" using hinges 32, and the folded panels 20*a* and 20*b* are then folded back along dotted lines "y" into parallel position with wall 12, before being pushed back into pocket 34 and into an out-of-the-way position.

Figure 7:
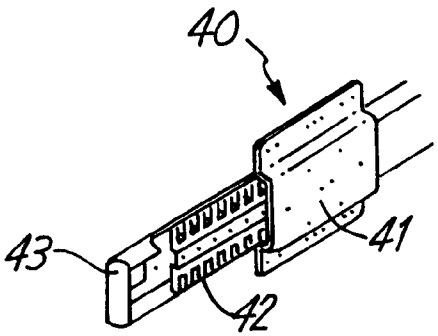
FIG. 7 shows slideable hinge for supporting the bifold door panels.

FIG. 7 shows slideable hinge 40 for pivotally supporting the bifold door panels to include a bracket 41 that is secured to the side of the cabinet 10 and a slide member 42 that slides in laterally within bracket 41. Located at the end of slide member 42 is an eye 43 for receiving a hinge pin that also engages the eye on the hinge on the front panels. Thus, the front panels can pivot about a vertical axis through eye 43 and when the door is folded and in alignment with the member 42 the door can be slid into the pocket on the side of the cabinet. While only one slide is shown, multiple slides can be used to provide the necessary support for the width and size of panel used.

Figure 6:
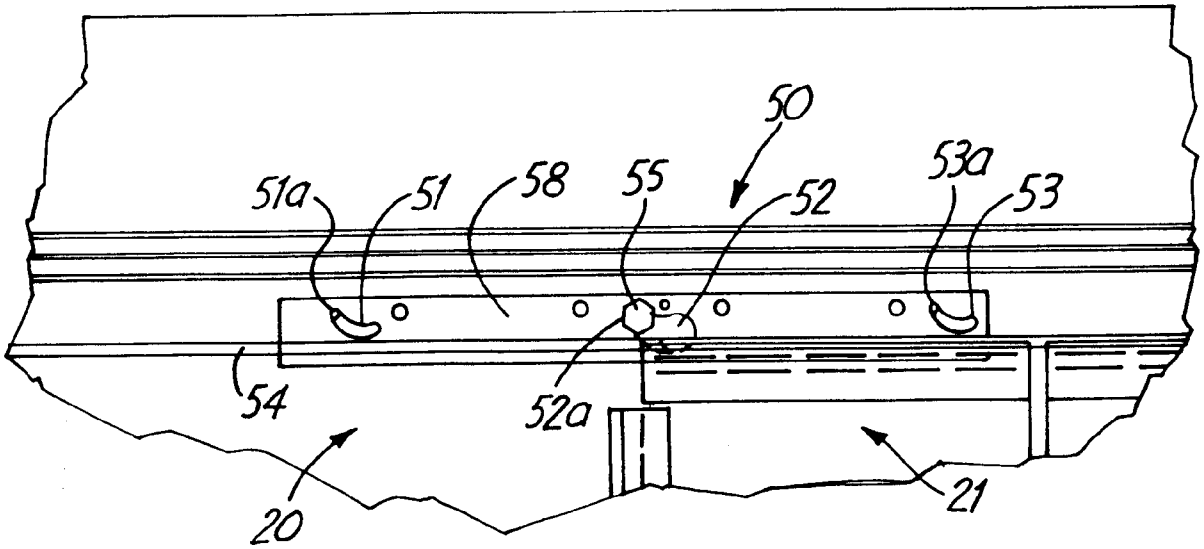
FIG. 6 shows the locking mechanism for securing the bifold doors in a closed condition.

FIG. 6 shows the locking mechanism 50 for holding the bifold doors in a closed condition. Locking mechanism 50 includes a bar 58 that slides up or down through cam slots 51, 52, and 53. That is, the rotation of key member 55 cause the bar to move with respect to cam members 51*a*, 52*a*, and 53*a*. Bar 58 is in the locked condition when the cam followers and cam are on the left side as illustrated in FIG. 6. When the lock member 55 is turned, it causes the bar 58 to move to the left with respect to the cam members thus elevating the bar free of the door. Consequently, with the bar 58 down, the door panels 20 and 21 are held between bar 58 and ledge 54 on the cabinet. However, when the bar is raised, the bar has sufficient clearance to allow the top of the panels and the doors to open.

When bar 58 is raised, the door panels are free to be swung outwardly. As the panels are pivoted about their hinges, the door panels 20*b* and 21*a* disengage as illustrated in FIG. 3. Next, the door panels are folded against each other and are extended perpendicular to the back side of cabinet 10 so that the door panels can be slidingly stored in the pockets of the cabinet. FIG. 5 illustrates how the door panels are folded and stored with door panels 21*a* and 21*b* stored in pocket 35. Door panels 20*a* and 20*b* are shown in the process of being folded together so that the door panels can be slid into pocket 34 by slideable hinge 30 and thus, into an out-of-the-way position.

We claim:

1. A security cabinet for displaying products comprising:

a cabinet housing, said cabinet housing having a pair of opposing side walls, a bottom section, a top section and a back wall that are connected together to form a front opening and an interior space for holding packages therein;

a first bifold door having a first panel and a second panel, said first bifold door having a first hinge located thereon to permit said first panel and said second panel to be foldably extended to a closed condition where the first panel and the second panel are located in an end to end relationship and in a substantially planer alignment with each other and also foldable to an open condition where the first panel and the second panel are located side by side to each other in a substantially parallel condition;

a second bifold door having a third panel and a fourth panel, said second bifold door having a second hinge located thereon to permit said third panel and said fourth panel to be foldably extended to a closed condition where the third panel and the fourth panel are located in an end to end relationship and in a substantially planer alignment with each other, and also foldable to an open condition where the third panel and the fourth panel are located side by side to each other in a substantially parallel condition;

a locking mechanism;

an elongated closure strip, said closure strip engaging an edge portion of said second panel so as not to be normally removable therefrom, said closure strip having a pair of jaws having an opening sufficiently large therebetween so as to permit an edge portion of said third panel to be engageable therein to permit said third panel and said second panel to be held in an edge to edge relationship and in substantially planar alignment with each other so that when said first panel, said second panel, said third panel, and said fourth panel are located in an end to end relationship, said panels coact with said cabinet housing and said locking mechanism to form a closure to prevent unauthorized access therein;

a first slideable hinge slideably mounted on one of said opposing walls, said first slideable hinge pivotally supporting said first panel and slideable along said one of said opposing walls to enable said first panel and said second panel to be slid therealong into an out-of-the-way condition; and a second slideable hinge slideably mounted on the other of said opposing walls, said second slideable hinge pivotally supporting said fourth panel and slideable along said other of said opposing walls to enable said third panel and said fourth panel to be slid therealong into an out-of-the-way condition to enable a person to obtain access to the interior space of said cabinet housing.

2. The security cabinet of claim 1 including a light extending along the top section to provide illumination of the interior space of said security cabinet.

3. The security cabinet of claim 1 including a first pocket located along one of said first opposing walls for containing said first bifold door therein and a second pocket located along the other of said opposing walls for containing said second bifold door therein.

4. The security cabinet of claim 1 wherein said panels are glass.

5. The security cabinet of claim 1 wherein said cabinet housing is metal.

6. The security cabinet of claim 1 wherein said closure strip frictionally engages said edge portion of said second panel.

7. The security cabinet of claim 1 wherein said jaws of said closure strip are of unequal length to enable the longer jaw to act as a guide to direct the edge portion of said third panel therein.

8. The security cabinet of claim 1 wherein said bifold doors are substantially rectilinear and said cabinet housing is substantially rectilinear.

9. The security cabinet of claim 1 wherein said cabinet housing includes a plurality of shelves located therein.

* * * * *